US009045915B2

(12) United States Patent
Field et al.

(10) Patent No.: US 9,045,915 B2
(45) Date of Patent: Jun. 2, 2015

(54) KEY WITH MOVABLE ELEMENT DISPOSED WITHIN KEY BLADE

(71) Applicant: MEDECO SECURITY LOCKS, INC., Salem, VA (US)

(72) Inventors: Peter H. Field, Salem, VA (US); Clyde T. Roberson, Salem, VA (US); Dan Boadwine, Salem, VA (US)

(73) Assignee: MEDECO SECURITY LOCKS, INC., Salem, VA (US)

( * ) Notice: Subject to any disclaimer, the term of this patent is extended or adjusted under 35 U.S.C. 154(b) by 0 days.

(21) Appl. No.: 14/146,918

(22) Filed: Jan. 3, 2014

(65) Prior Publication Data

US 2014/0190223 A1 Jul. 10, 2014

Related U.S. Application Data

(60) Provisional application No. 61/748,892, filed on Jan. 4, 2013.

(51) Int. Cl.
*E05B 19/00* (2006.01)
*E05B 35/00* (2006.01)

(52) U.S. Cl.
CPC ..... *E05B 19/0017* (2013.01); *E05B 35/003* (2013.01)

(58) Field of Classification Search
CPC ... E05B 35/003; E05B 19/00; E05B 19/0058; E05B 19/0017; Y10S 70/37
USPC ..... 70/336, 344, 409, 402, 405, 406, 410, 70/411, 412
See application file for complete search history.

(56) References Cited

U.S. PATENT DOCUMENTS

| | | | | |
|---|---|---|---|---|
| 947,913 | A * | 2/1910 | Jenkins | 70/265 |
| 1,382,826 | A | 6/1921 | Dove | |
| 2,438,435 | A | 3/1948 | Gagnon | |
| 2,440,428 | A | 4/1948 | Best | |

(Continued)

FOREIGN PATENT DOCUMENTS

| | | | |
|---|---|---|---|
| EP | 0 802 289 | A2 | 10/1997 |
| ES | 2 088 345 | A2 | 8/1996 |

(Continued)

OTHER PUBLICATIONS

International Search Report and Written Opinion issued in PCT/US2014/010350 dated May 22, 2014, 14 pages.

*Primary Examiner* — Christopher Boswell
*Assistant Examiner* — Amanda L Miller
(74) *Attorney, Agent, or Firm* — Rothwell, Figg, Ernst & Manbeck PC

(57) ABSTRACT

A key with one or more movable elements that slide within the blade of a substantially flat key for operating a lock includes a blade configured to be inserted into a keyway of a lock and including contour features formed on an outer surface of the blade that mate with corresponding contour features of the keyway. The key includes at least one movable element disposed within a recess formed in the blade and including a contour surface exposed to the exterior of the key blade. The contour surface may include external contour features that correspond in shape to at least a portion of the contour features of the keyway. The movable element may be movable within the recess, when it engages a blocking member within the keyway, and after such movement, the element will engage a locking element within the lock.

11 Claims, 8 Drawing Sheets

(56) References Cited

U.S. PATENT DOCUMENTS

| | | | | | |
|---|---|---|---|---|---|
| 3,486,355 | A | | 12/1969 | Halfyard | |
| 4,377,082 | A | | 3/1983 | Wolter | |
| 4,545,226 | A | | 10/1985 | Urrestarazu-Borda | |
| 4,662,200 | A | | 5/1987 | Borda | |
| 4,667,495 | A | | 5/1987 | Girard et al. | |
| 5,076,081 | A | | 12/1991 | Boris, Jr. | |
| 5,086,632 | A | * | 2/1992 | Hsu | 70/375 |
| 5,170,651 | A | * | 12/1992 | Errani | 70/493 |
| 5,437,176 | A | | 8/1995 | Keller | |
| 5,457,974 | A | | 10/1995 | Keller | |
| 5,520,035 | A | * | 5/1996 | Eizen et al. | 70/358 |
| 5,533,369 | A | | 7/1996 | Valdajos-Gallego | |
| 5,775,144 | A | * | 7/1998 | Pagalday | 70/358 |
| 5,778,712 | A | | 7/1998 | Wallden | |
| 5,784,910 | A | | 7/1998 | Eizen et al. | |
| 5,839,308 | A | | 11/1998 | Eizen et al. | |
| 6,125,674 | A | | 10/2000 | Aramburu | |
| 2011/0048084 | A1 | * | 3/2011 | Tong | 70/491 |
| 2011/0072867 | A1 | * | 3/2011 | Haviv et al. | 70/357 |
| 2011/0265530 | A1 | * | 11/2011 | Nicoara | 70/344 |

FOREIGN PATENT DOCUMENTS

| | | | |
|---|---|---|---|
| FR | 2 522 053 | A1 | 8/1983 |
| FR | 2 776 327 | A1 | 9/1999 |
| FR | 2776327 | A1 | 9/1999 |

* cited by examiner

KEY WITH MOVABLE ELEMENT DISPOSED WITHIN KEY BLADE

PRIORITY CLAIM

This application claims the benefit under 35 U.S.C. §119 (e) of U.S. Provisional Application No. 61/748,892, filed Jan. 4, 2013, the disclosure of which is hereby incorporated by reference in its entirety.

FIELD OF THE INVENTION

This invention relates to multiple-part keys that operate locks, and specifically to keys with movable elements that slide within the blade of a substantially flat key when the key is inserted into the keyway of a lock, whereby the movable element contacts a locking element and moves the locking element from a locked position to an unlocked position.

BACKGROUND

A variety of keys having one or more movable parts integrated into or onto the key blade and associated locks are known. For example, keys with slidable, or otherwise movable, elements within or on the blade are disclosed, for example, in U.S. Pat Nos. 947,913, 2,438,435, 2,440,428, 3,486,355, 4,377,082, 4,545,226, 4,662,200, 4,667,495, 5,076,081, 5,437,176, 5,457,974, 5,520,035, 5,533,369, 5,778,712, 5,784,910, and 5,839,308. All documents mentioned herein are hereby incorporated by reference in their entirety.

However, these prior art keys have disadvantages. The prior art keys describe slidable elements that move to a position projecting outside of the rectangular profile of the key blade defined by the greatest height and width of the key blade. For example, U.S. Pat. No. 3,486,355 illustrates a key that has a sliding wire within it that extends above the blade of the key and positions a pin tumbler in the cylinder. U.S. Pat. Nos. 4,545,226 and 4,662,200 illustrate a key with bittings that slide along the length of the blade and can be adjusted to position the blocking tumblers within a cylinder. The projection of such elements outside the substantially rectangular shape of the key blade increases the likelihood of damage to the movable element and increases the size of the key blade itself.

Accordingly, it would be desirable to have a key with a movable element integrated into the key blade, such that the movable element does not extend outside of the rectangular profile of the key blade defined by the greatest height and width of the key blade, but rather the shape of the grooves and ridges on the blade is distorted by movement of the element. It would be further desirable to have a key with a movable element integrated into the key blade, that is shaped to correspond to a portion of the interior of the keyway, such that the movable element moves in the key so that the shape of the element is displaced in relation to the ridges and grooves of the keyway.

SUMMARY OF INVENTION

According to exemplary embodiments, a key with one or more movable elements that slide within the blade of a substantially flat key for operating a lock is provided. More specifically, aspects of the invention are embodied in a key for operating a lock and comprising a blade configured to be inserted into a keyway of a lock and including contour features formed on an outer surface of the blade that mate with corresponding contour features of the keyway. The key includes at least one movable element disposed within a recess formed in the blade and including a contour surface exposed to the exterior of the key blade. The contour surface may include external contour features that correspond in shape to at least a portion of the contour features of the keyway. The movable element may be movable within the recess between a first position and a second position. The first position may be a position in which the external contour features of the contour surface of the movable element cooperate with the contour features of the key blade, such that the contour features of the blade and movable element mate with the corresponding contour features of the keyway. The second position may be a position in which the external contour features of the contour surface of the movable element are displaced with respect to the contour features of the key blade, such that the contour features of the movable element do not mate with the corresponding contour features of the keyway.

According to further aspects of the invention, the movable element may be configured to contact a blocking member located within a keyway as the key blade is inserted into the keyway, whereby contact with the blocking member causes the movable element to move from the first position toward the second position.

According to further aspects of the invention, the movable element may be configured to contact a locking element of the lock when the movable element is in the second position and the blade is further inserted into the keyway, whereby the contact between the movable element and the locking element causes the locking element to move from a locked position to an un-locked position.

According to further aspects of the invention, the blade may comprise opposed sides extending longitudinally of the blade and defining a height of the blade, and edges extending between the opposed sides and defining a thickness of the blade, wherein the height of the blade is greater than the thickness of the blade. The movable element and the recess may be constructed and arranged such that the movable element is movable between the first position and the second position in a direction that is parallel to the height of the blade.

According to further aspects of the invention, the movable element may be movable between the first and second positions in a vertical direction when the key blade is inserted into a keyway in a horizontal direction.

According to further aspects of the invention, the movable element may have a shape that is rectangular, cubical, cylindrical, or spherical.

According to further aspects of the invention, the movable element may comprise a body of revolution that is symmetric about a longitudinal axis thereof and may include regions of varying diameter along the longitudinal axis.

According to further aspects of the invention, the movable element may comprise a sliding body having straight sides, a straight bottom end, and a rounded top end; a projecting face projecting from the sliding body and having straight sides, a flat bottom corresponding to the bottom of the sliding body, and a rounded top; and at least one of a groove and a ridge formed in the front surface of the projecting face.

According to further aspects of the invention, the movable element and recess may be configured such that the movable element does not extend out of the blade when the movable element moves from the first position to the second position.

According to further aspects of the invention, the movable element and recess may be configured such that the movable element does not extend beyond a portion of greatest thickness of the blade.

According to further aspects of the invention, the movable element may be free floating within the recess According to further aspects of the invention, the movable element may be under spring pressure biasing the movable element into a predetermined position within the recess.

Other features and characteristics of the present invention, as well as the methods of operation, functions of related elements of structure and the combination of parts, and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

The accompanying drawings, which are incorporated herein and form part of the specification, illustrate various, non-limiting embodiments of the present invention. In the drawings, common reference numbers indicate identical or functionally similar elements.

DETAILED DESCRIPTION OF THE INVENTION

Figure 1B:
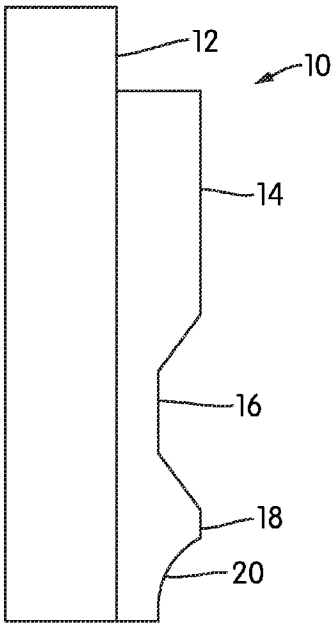
FIG. 1B is a side view of the movable element shown in FIG. 1A.

Unless defined otherwise, all terms of art, notations and other technical terms or terminology used herein have the same meaning as is commonly understood by one of ordinary skill in the art to which this disclosure belongs. All patents, applications, published applications and other publications referred to herein are incorporated by reference in their entirety. If a definition set forth in this section is contrary to or otherwise inconsistent with a definition set forth in the patents, applications, published applications, and other publications that are herein incorporated by reference, the definition set forth in this section prevails over the definition that is incorporated herein by reference.

Unless otherwise indicated or the context suggests otherwise, as used herein, "a" or "an" means "at least one" or "one or more."

This description may use relative spatial and/or orientation terms in describing the position and/or orientation of a component, apparatus, location, feature, or a portion thereof. Unless specifically stated, or otherwise dictated by the context of the description, such terms, including, without limitation, top, bottom, above, below, under, on top of, upper, lower, left of, right of, in front of, behind, next to, adjacent, between, horizontal, vertical, diagonal, longitudinal, transverse, etc., are used for convenience in referring to such component, apparatus, location, feature, or a portion thereof in the drawings and are not intended to be limiting.

Furthermore, unless otherwise stated, any specific dimensions mentioned in this description are merely representative of an exemplary implementation of a device embodying aspects of the invention and are not intended to be limiting.

Aspects of the invention are embodied in a key, for example a key for operating a cylinder or other type of lock, having a movable element retained within a recess or chamber formed in the key blade and movable within the recess or chamber relative to the key blade. An exemplary movable element 10 is shown in FIGS. 1A, 1B, and 1C, and exemplary keys 40, 60, configured to receive the movable element 10, are shown in FIGS. 2-5.

Figure 1C:
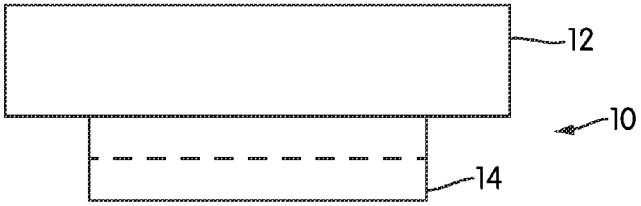
FIG. 1C is a top view of the movable element shown in FIGS. 1A and 1B.
Figure 1A:
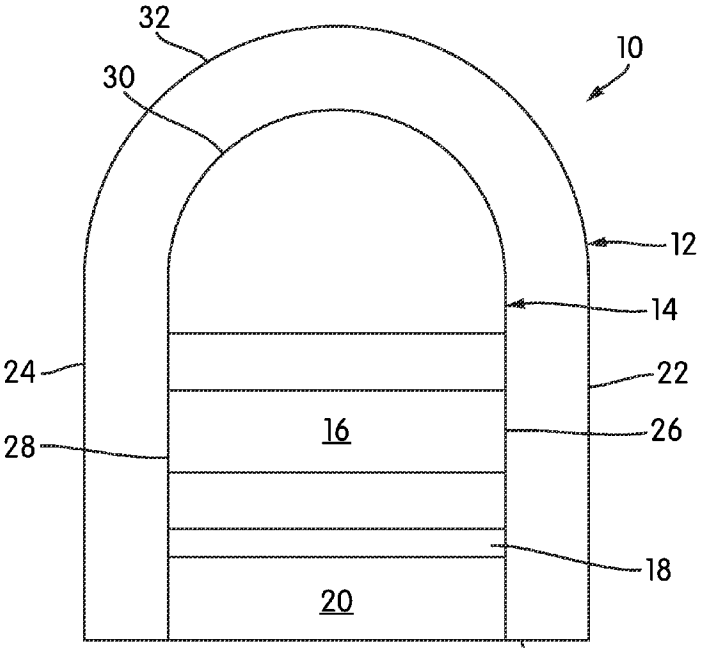
FIG. 1A is a front view of a movable element configured to be incorporated into a recess formed in the blade of a key embodying aspects of the present invention.

FIGS. 1A, 1B, and 1C are a front view, side view, and top view, respectively, of an embodiment of a movable element 10. In one non-limiting embodiment, the movable element 10 includes a sliding body 12 having straight sides 22, 24, a straight bottom end 34, and a rounded top end 32. A projecting face 14 projects from the sliding body 12 and has straight sides 26, 28, a flat bottom corresponding to the bottom 34 of the sliding body 12, and a rounded top 30. Grooves 16 and 20 and a ridge 18 are formed in the front surface of the projecting face 14. The number and shapes of grooves and/or ridges formed on the projecting face will vary depending on the contours of a keyway configured to receive the key in which the movable element 10 is disposed, as will be described in more detail below.

Figure 2:
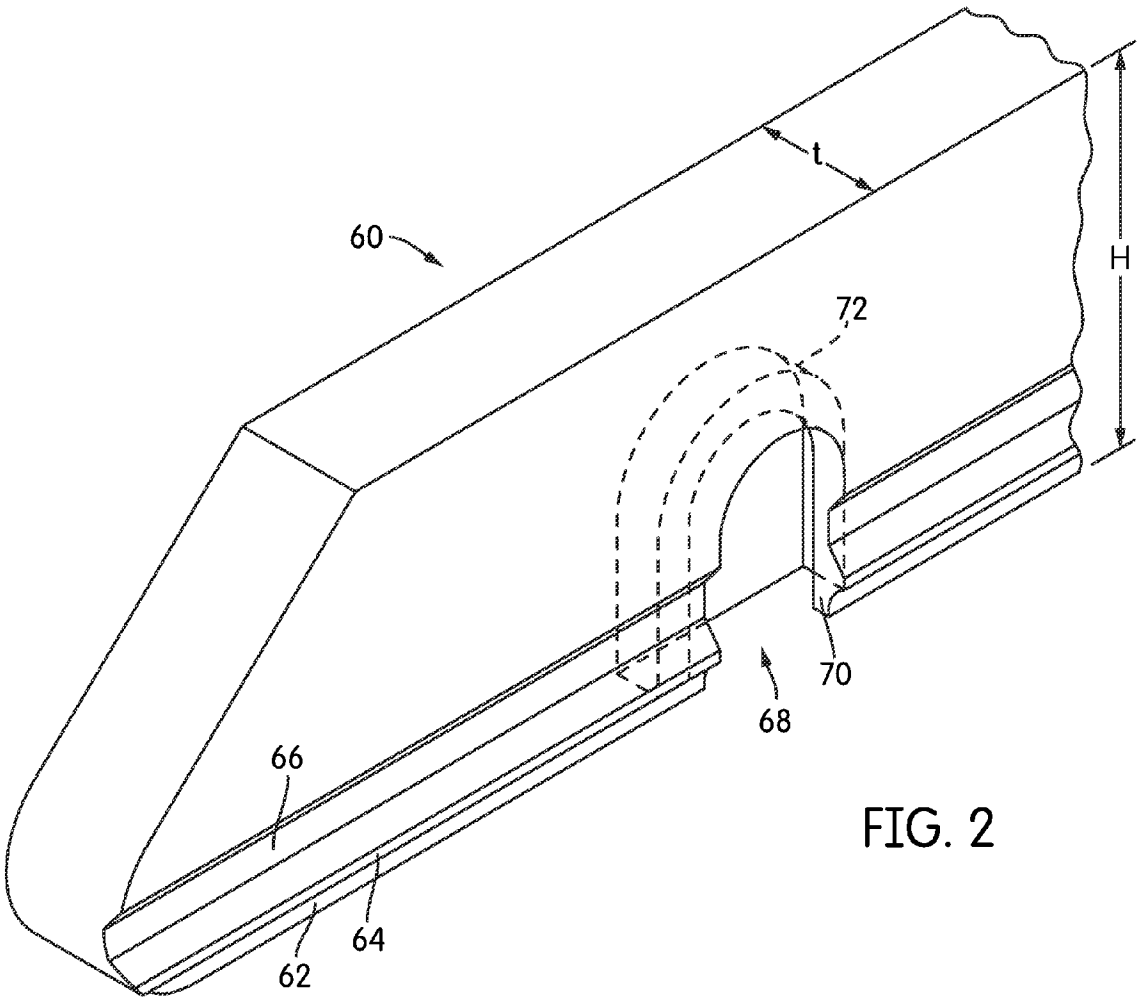
FIG. 2 is a partial perspective view of a key blade having a recess for receiving a movable element.
Figure 3:
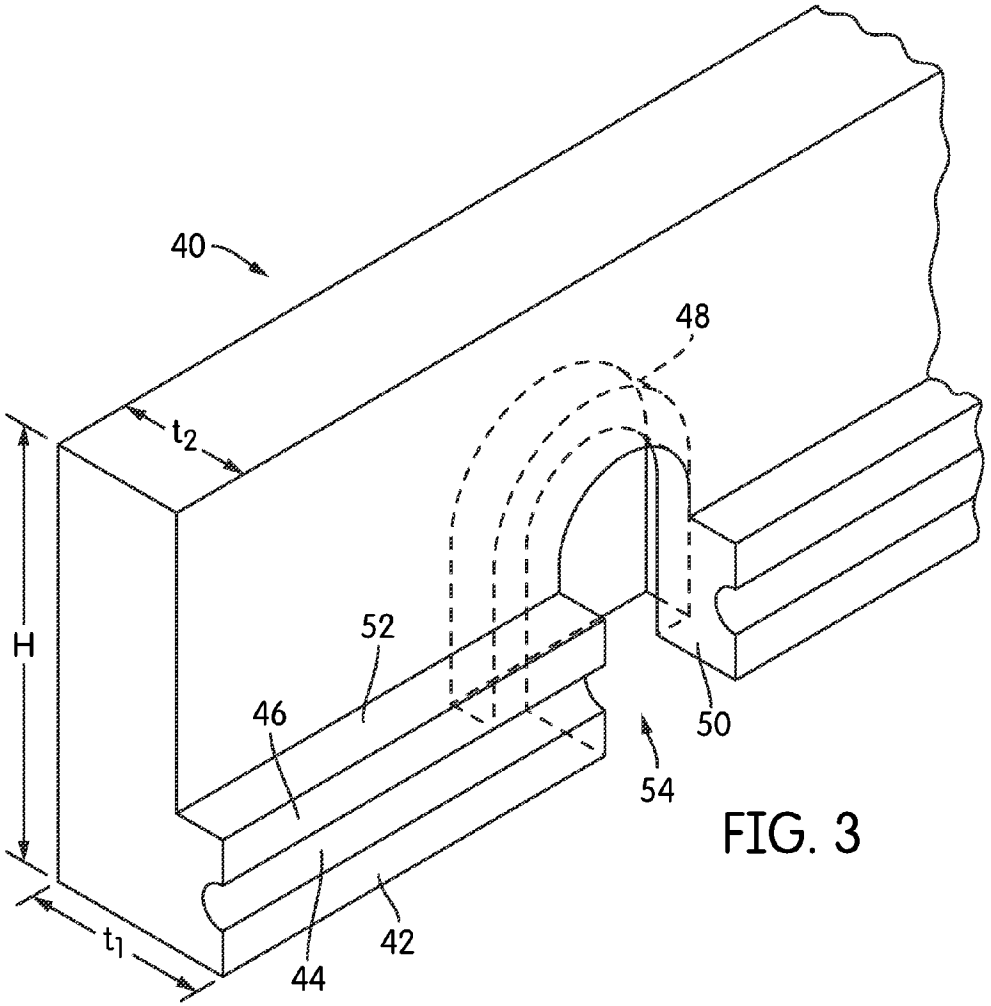
FIG. 3 is a partial perspective view of an alternative embodiment of a key blade having a recess for receiving a movable element.
Figure 4:
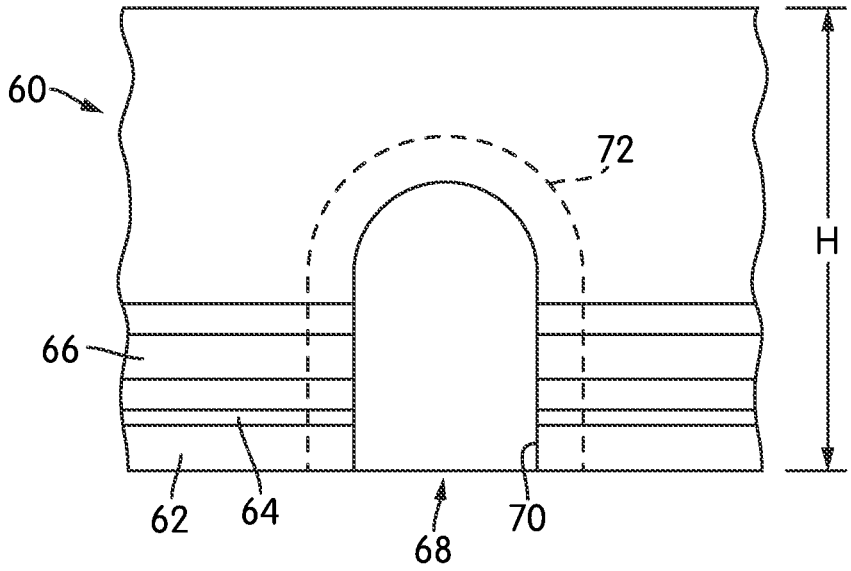
FIG. 4 is a partial side view of the key blade of FIG. 2.

FIGS. 2 and 4 are partial perspective and side views, respectively, of a first, non-limiting embodiment of a key blade 60 embodying aspects of the present invention. Similarly, FIGS. 3 and 5 are partial perspective and side views, respectively, of a second, non-limiting embodiment of a key blade 40 embodying aspects of the present invention.

As shown in FIGS. 2 and 4, the blade 60 has flat, generally parallel, opposed sides defining a height "H" and narrow top and bottom edges generally defining a thickness "t". The thickness "t" generally defines the portion of the blade with the greatest thickness. Blade 60 further includes grooves 62 and 64 and a ridge 66 extending longitudinally of its length. The number of grooves and/or ridges shown is not intended to be limiting; the blade may have more or less grooves and/or ridges than are shown.

A recess 68 is formed in a portion of the blade 60. Recess 68 has an opening 70 at one side of the blade and may be open at a bottom edge of the blade. Recess 68 further includes an internal portion 72, shown in hidden lines in FIGS. 2 and 4, having larger dimensions than the opening 70 and which extends into the interior of the key blade 60. Recess 68 may be formed in the key blade 60 by any suitable forming, stamping, and/or machining technique. The key illustrated in FIGS. 2 and 4 has a single recess 68, but the blade may have more than one recess. Moreover, the configuration of recess 68 shown in FIGS. 2 and 4 is exemplary; the recess may have other configurations and shapes, and, if the key blade has more than one recess, it is not necessary that all recesses have the same configuration.

Figure 5:
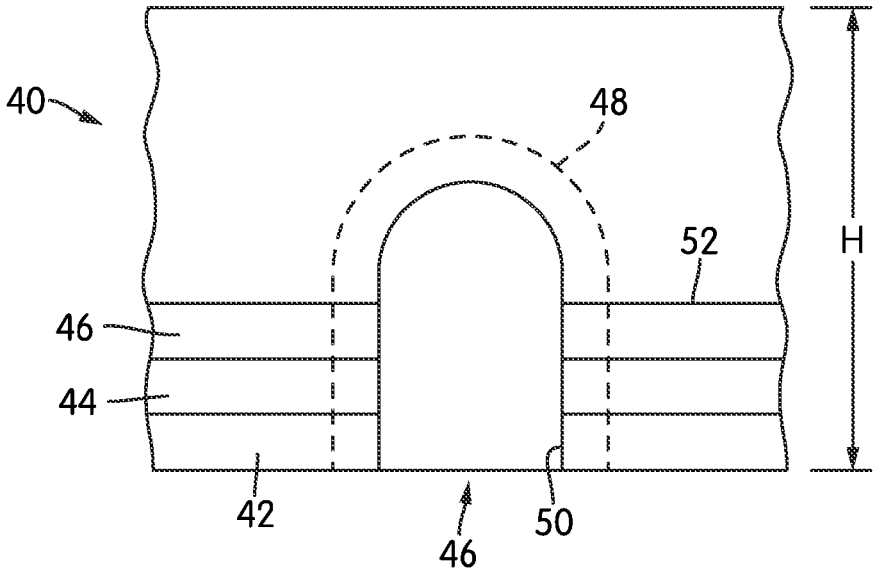
FIG. 5 is a partial side view of the key blade of FIG. 3.

As shown in FIGS. 3 and 5, the blade 40 has a first, flat side defining a height "H" (the left-hand side in FIG. 3) and a second side having a lateral projection 52 thereby defining an "L" shaped transverse cross section with a bottom width $t_1$ and a top width $t_2$ that is smaller than the bottom width $t_1$. The width "$t_1$" generally defines the portion of the blade with the greatest thickness. Blade 40 shown in the figures includes a groove 44 and ridges 42 and 46 formed in a side of the lateral projection 52. Again, the number of grooves and/or ridges shown is not intended to be limiting.

A recess 54 is formed in a portion of the blade 40 (in the lateral projection 52 in the illustrated embodiment). Recess 54 has an opening 50 at one side of the blade and may be open at a bottom edge of the blade. Recess 54 further includes an internal portion 48, shown in hidden lines in FIGS. 3 and 5, having larger dimensions than the opening 50 and which extends into the interior of the key blade 40. Recess 54 may be formed in the key blade 40 by any suitable forming, stamping, and/or machining technique. The key illustrated in FIGS. 3 and 5 has a single recess 54, but the blade may have more than one recess. Moreover, the configuration of recess 54 shown in FIGS. 3 and 5 is exemplary; the recess may have other configurations and shapes, and, if the key blade has more than one recess, it is not necessary that all recesses have the same configuration.

A movable element, such as movable element 10 shown in FIGS. 1A, 1B and 1C, is retained within the recess 68 of the key blade 60 or within the recess 54 of the key blade 40. Note that movable element 10 has a shape generally conforming to the configuration of recess 68 and recess 54. The sliding body 12 of the movable element 10 is disposed within the internal portion 72 of recess 68 or within internal portion 48 of recess 54, and the projecting face 14 of the movable element 10 projects through the opening 70 of recess 68 or the opening 50 of recess 54 to the exterior of the blade 60, 40. The movable element 10 is configured such that it can move and be displaced vertically up and down (i.e., in the direction corresponding to the height dimension "H") in the blade 60 or 40, when the blade is inserted horizontally into the keyway. In general, the movable element moves perpendicular to the length of the blade.

Figure 6A:
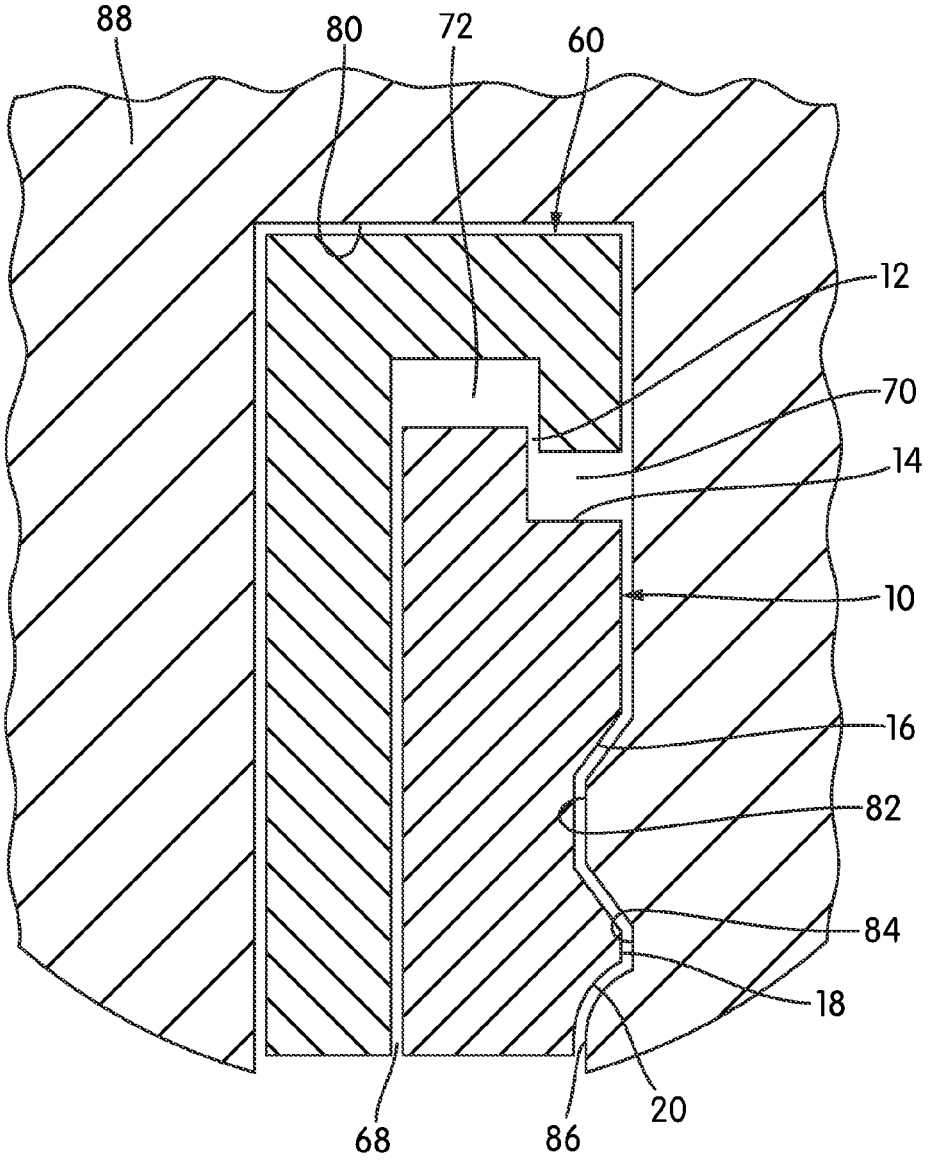
FIG. 6A is a transverse cross-sectional view of a key blade inserted into a keyway with a movable element disposed within a recess of the key blade.

The movable element 10 has a contoured surface including grooves and ridges (e.g., grooves 16 and 20 and ridge 18) on at least one exterior side, such as on the projecting face 14, and that surface corresponds to the shape of a portion of the keyway and the matching key blade 60, 40. FIG. 6A is a transverse cross-sectional view through key blade 60 at the location of the recess 68 and showing the key blade 60 inserted into a keyway 80 formed in a cylinder plug 88 of a lock. As the key blade 60 in inserted into a keyway 80, the movable element 10 is positioned by the ridges 82, 86 and groove 84 that make up the interior of the keyway 80 (i.e., the warding, or contour elements, of the keyway) engaging and aligning with the grooves 16, 20 and ridge 18, respectively, of the projecting face 14, so that the key blade 60 and movable element 10 fit into the keyway 80. As the key blade 60 is inserted into the keyway 80, the movable element 10 contacts a blocking member positioned on a side of the keyway 80. At or near the location of the blocking member, an interruption to the contour elements of the keyway 80 (e.g., portions of the grooves and/or ridges are removed) creates a vertical clearance that allows the movable element 10 to move, within the recess 68, up or down relative to the key blade 60 and the keyway 80 when the movable element 10 contacts the blocking member. In non-limiting embodiments, the clearance could be made by drilling a clearance hole from the side of the cylinder into the keyway and drilling away a part of a rib that extends into the keyway, or the hole forming the clearance could be drilled/milled from the bottom of the cylinder into the side of the keyway.

In non-limiting embodiments, the blocking member may, for example, be a spring-like element (e.g., a leaf spring or spring-biased pin) or other positioning element within the keyway that cooperates with the moveable element to cause the movable element to move vertically within the key blade. In another non-limiting embodiment, the blocking member may, for example, be a cam-like surface or feature of the keyway that is configured to engage the moveable element, such that the moveable element moves vertically in the internal portion of the recess and clearance.

Figure 6B:
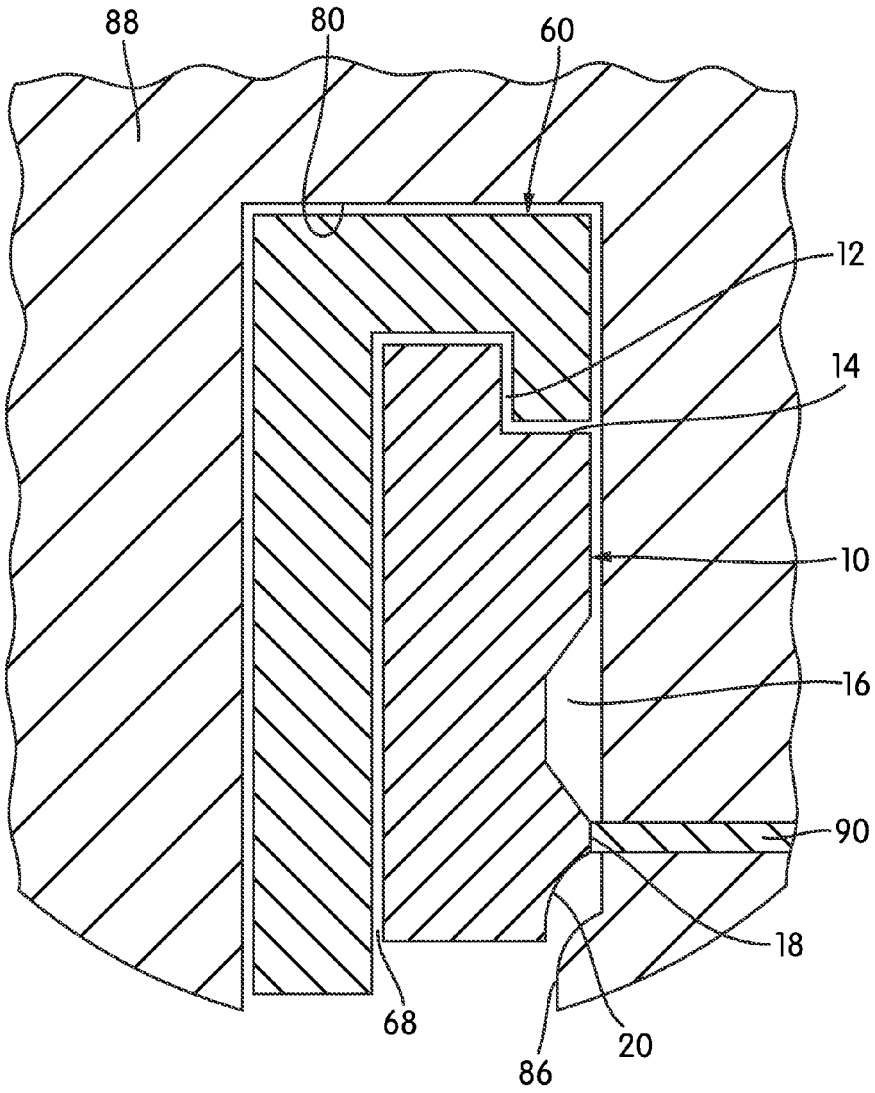
FIG. 6B is a transverse cross-sectional view of a key blade further inserted into the keyway of FIG. 6A with a movable element disposed within a recess of the key blade.

When the movable element 10 is shifted in the vertical direction within the recess 68, at least one projecting portion (e.g., a ridge) of the contoured surface of projecting face 14 of the movable element 10 is displaced to a position behind a rib of the keyway contour. In this location, further insertion of the key into the keyway causes the movable element 10 to contact a locking element within the cylinder plug 88 and move that locking element from a locking position, status, or orientation to an unlocking position, status, or orientation. For example, FIG. 6B is a transverse cross-sectional view through key blade 60, at a position where the key blade is further advanced into the keyway than shown in FIG. 6A. At this position, the clearance in the keyway is created such that a portion of the projecting ridge 82 is removed from the key way 80, so that the movable element 10 can move vertically within the internal portion 72 of recess 68. Such vertical movement allows ridge 18, for example, to move into the gap formerly occupied by ridge 82. Further advance of the key blade 60 causes ridge 18 to contact and actuate a locking element, such as pin 90 projecting laterally into the keyway. The positioning and type of locking element is not intended to be limiting.

As noted, the shape of the movable element shown in the drawings is exemplary and not intended to be limiting. The movable element can be any suitable configuration, including rectangular, cylindrical, cubical, or spherical.

The movable element can be free floating within the recess formed in the key blade, or the movable element can be under spring pressure biasing the movable element into a predetermined position within the recess.

The movable element may include contact surfaces for contacting the blocking member and for contacting the locking element. The contact surface for contacting the blocking member may be located on the same side of the key blade as a contact surface for contacting the locking element, or the contact surfaces can be on different sides of the key.

Figure 7:
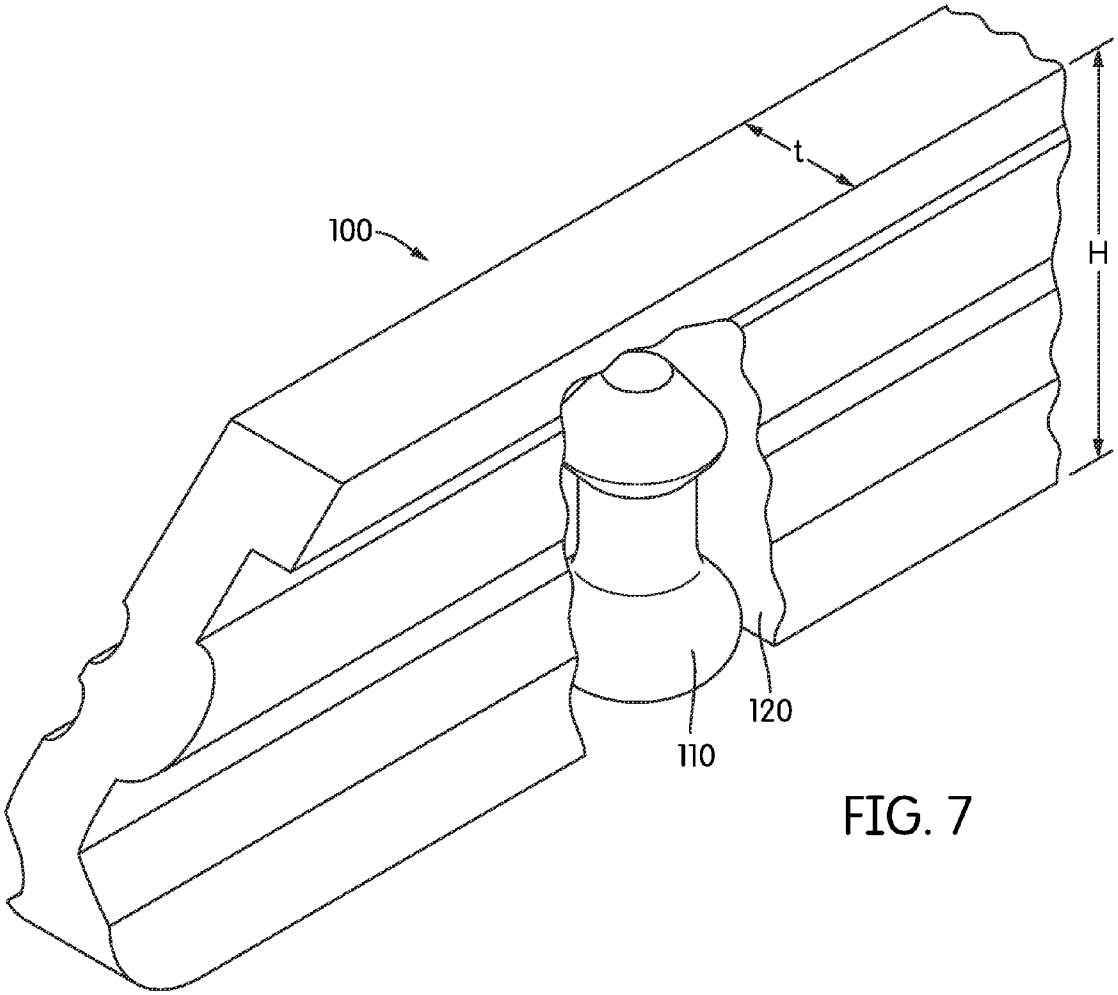
FIG. 7 is a partial perspective, cut-away view of an alternative embodiment of a key blade having a movable element disposed in a recess thereof.

The movable element 10 shown in the embodiments of FIGS. 1-6 includes a projecting face 14 and a contour surface disposed on only one side of the key blade 40, 60 and engageable with the contours on only one side of the keyway 80. In an alternate embodiment, shown in FIGS. 7-9, a movable element 110 disposed within a recess 112 (as shown, for example, in FIG. 8) of a key blade 100, having grooves and ridges formed on both sides of the blade 100 may be in the form of a body of revolution. Cut-away 120 shows an exemplary disposition of the movable element 110 within the key blade 100. In the illustrated embodiment, the movable element 110 is symmetric about a longitudinal axis that is parallel to the height dimension ("H") of the blade 100. The movable element 110 has regions of varying diameter along the longitudinal axis that define grooves and/or ridges that align with the grooves and ridges on both sides of the key blade 100 when the blade 100 is inserted into a keyway. Engagement of the movable element 110 with the internal contours of the keyway moves the movable element 110 into a position of alignment with the grooves and ridges of the key blade 100. As the blade 100 is inserted into the keyway, the movable element 110 contacts a blocking member, which causes the movable element to move within the recess and a clearance formed in the internal surface contours of the keyway, thereby displacing the movable element 110 with respect to the grooves and ridges of the key blade 100. Further insertion of the key blade into the keyway causes the displaced movable element 110 to contact a locking element within the lock and move the locking element from a locked position, status, or orientation to an unlocked position, status, or orientation.

Figure 8:
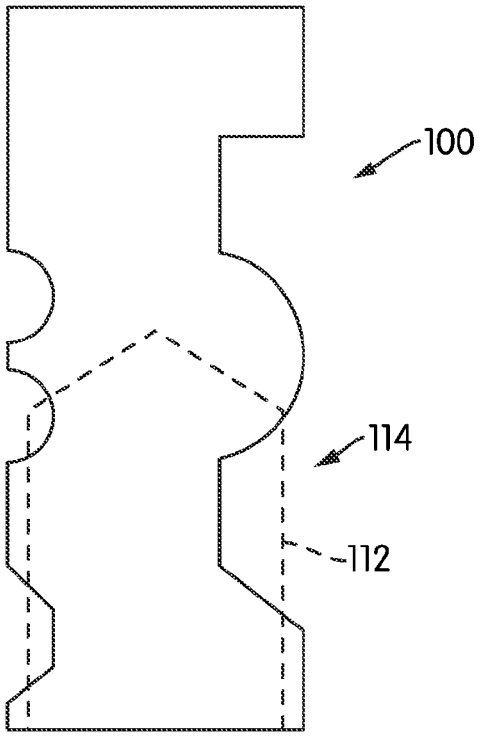
FIG. 8 is an end view of the key blade of FIG. 7.
Figure 9:
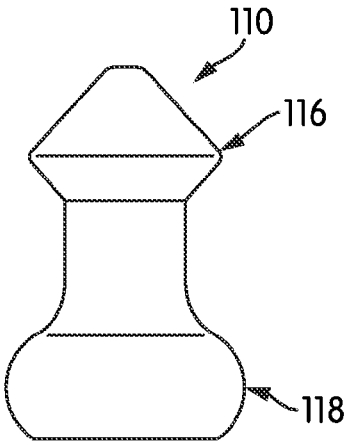
FIG. 9 is a side view of an alternative embodiment of a movable element.

In one example, the key blade 100, as represented in FIG. 8, has a large groove 114. The keyway in the cylinder would have a projection (e.g. a ridge) that enters a bottom portion of the large groove 114, as the key blade is inserted, but leaves a top portion of the large groove 114 empty near the face of the cylinder, such that an upper ridge 116 on the movable element 110 can ride in that empty space. As the key blade 100 is inserted into the keyway, the movable element 110 would move into the keyway with the key blade. As the key blade 100 is further advanced into the cylinder, a portion of the upper ridge 116 of the movable element 110 may contact a blocking member, for example a beveled pin inserted into the keyway at a vertical position near the top portion of the large groove 114 in the side of the key blade. The blocking member can be positioned at the location of the clearance in the keyway that removes a portion of the projecting keyway ridges, such that when a portion of the upper ridge 116 of the movable element 110 contacts the blocking member, the movable element 110 moves vertically. With the movable element 110 elevated into the key blade 100, a portion of an enlarged rounded bottom 118 of the movable element 110 moves vertically in the clearance to contact a locking element.

Again, the configuration of the illustrated embodiment is exemplary; the movable element need not be in the form of a body of revolution. The movable element may be, for example, rectangular or cubical in cross section, with regions of varying width along its longitudinal axis defining grooves and ridges that can be aligned with the grooves and ridges of the key blade 100.

The movable element is shaped to correspond to a portion of the interior of the keyway and moves vertically in the key blade so that the shape of the element is displaced in relation to the ridges and grooves of the keyway. The movable element does not extend outside of the rectangular shape of the blade but the shape of the grooves and ridges on the blade is distorted by the movement of the element.

While the present invention has been described and shown in considerable detail with reference to certain illustrative embodiments, including various combinations and sub-combinations of features, those skilled in the art will readily appreciate other embodiments and variations and modifications thereof as encompassed within the scope of the present invention. Moreover, the descriptions of such embodiments, combinations, and sub-combinations is not intended to convey that the inventions requires features or combinations of features other than those expressly recited in the claims. Accordingly, the present invention is deemed to include all modifications and variations encompassed within the spirit and scope of the following appended claims.

The invention claimed is:

1. A key for operating a lock and comprising:

a blade configured to be inserted into a keyway of a lock and including contour features comprising at least one of a groove and a ridge formed on an outer surface of the blade that mate with corresponding contour features of the keyway; and at least one movable element disposed within an associated recess formed in the blade and including a contour surface exposed to the exterior of the key blade, the contour surface including external contour features comprising at least one of a groove and a ridge that correspond in shape to at least a portion of the contour features of the blade, wherein each movable element is movable within its associated recess between:

(a) a first position in which the external contour features of the contour surface of the movable element are aligned with the contour features of the key blade, such that the contour features of the blade and movable element mate with the corresponding contour features of the keyway and (b) a second position in which the external contour features of the contour surface of the movable element are misaligned with respect to the contour features of the key blade, such that the contour features of the movable element do not mate with the corresponding contour features of the keyway.

2. The key of claim 1, wherein the movable element is configured to contact a locking element of the lock when the movable element is in the second position and the blade is further inserted into the keyway, whereby the contact between the movable element and the locking element causes the locking element to move from a locked position to an un-locked position.

3. The key of claim 1, wherein the blade comprises:

opposed sides extending longitudinally of the blade and defining a height of the blade; and edges extending between the opposed sides and defining a thickness of the blade, wherein the height of the blade is greater than the thickness of the blade, and wherein the movable element and the recess are constructed and arranged such that the movable element is movable between the first position and the second position in a direction that is parallel to the height of the blade.

4. The key of claim 1, wherein the movable element is movable between the first and second positions in a vertical direction when the blade is inserted into a keyway in a horizontal direction.

5. The key of claim 1, wherein the movable element has a shape that is rectangular, cubical, cylindrical, or spherical.

6. The key of claim 1, wherein the movable element comprises a body of revolution that is symmetric about a longitudinal axis thereof and includes regions of varying diameter along the longitudinal axis.

7. The key of claim 1, wherein the movable element comprises:

a sliding body having straight sides, a straight bottom end, and a rounded top end; and a projecting face projecting from the sliding body and having straight sides, a flat bottom corresponding to the bottom of the sliding body, and a rounded top.

8. The key of claim 1, wherein the movable element and recess are configured such that the movable element does not extend out of the blade when the movable element moves from the first position to the second position.

9. The key of claims 1, wherein the movable element and recess are configured such that the movable element does not extend beyond a portion of the blade with the greatest thickness.

10. The key of claim 1, wherein the movable element is free floating within the recess.

11. The key of claim 1, wherein the movable element is under spring pressure biasing the movable element into a predetermined position within the recess.

* * * * *